US007101225B2

(12) United States Patent
Kohler

(10) Patent No.: US 7,101,225 B2
(45) Date of Patent: Sep. 5, 2006

(54) SHIELDED HIGH-DENSITY EDGE CONNECTOR

(75) Inventor: Andreas Kohler, Minden (DE)

(73) Assignee: Harting Electronics GmbH & Co. KG, (DE)

( * ) Notice: Subject to any disclaimer, the term of this patent is extended or adjusted under 35 U.S.C. 154(b) by 0 days.

(21) Appl. No.: 11/280,598

(22) Filed: Nov. 16, 2005

(65) Prior Publication Data

US 2006/0134987 A1 Jun. 22, 2006

(30) Foreign Application Priority Data

Dec. 17, 2004 (DE) ..... 10 2004 060 782

(51) Int. Cl.
*H01R 13/648* (2006.01)

(52) U.S. Cl. ..... 439/608; 439/95; 439/108

(58) Field of Classification Search ..... 439/95, 439/108, 607, 608, 701
See application file for complete search history.

(56) References Cited

U.S. PATENT DOCUMENTS

| | | | | |
|---|---|---|---|---|
| 6,478,631 | B1 * | 11/2002 | Dutton et al. | 439/707 |
| 6,641,438 | B1 * | 11/2003 | Billman | 439/608 |
| 6,776,649 | B1 * | 8/2004 | Pape et al. | 439/485 |
| 6,814,620 | B1 * | 11/2004 | Wu | 439/608 |
| 6,948,951 | B1 * | 9/2005 | Wu et al. | 439/108 |
| 2003/0123236 | A1 | 7/2003 | McGrath et al. | |
| 2004/0235321 | A1 | 11/2004 | Mizumura et al. | |
| 2005/0042926 | A1 * | 2/2005 | Pan et al. | 439/608 |

FOREIGN PATENT DOCUMENTS

| | | |
|---|---|---|
| EP | 0 568 906 | 12/1998 |
| EP | 1 096 610 | 5/2001 |

* cited by examiner

*Primary Examiner*—James R. Harvey
(74) *Attorney, Agent, or Firm*—Hayes Soloway P.C.

(57) ABSTRACT

A shielded high-density edge connector comprises a metallic connector housing for accommodating several adjacently arranged segments with electric contacts held therein. The number of contacts between the mating side and the terminal side of the edge connector can be reduced by providing the contacts within the segments and the connector housing.

10 Claims, 13 Drawing Sheets

SHIELDED HIGH-DENSITY EDGE CONNECTOR

FIELD OF THE INVENTION

The invention pertains to a shielded high-density edge connector with a terminal side for connection to a mother board and a mating side for connection to a daughter board.

BACKGROUND OF THE INVENTION

An edge connector of the above type is required for transferring differential signal voltages from a mother board to a daughter board by means of numerous electric contacts, wherein a shielding is provided to both sides of the contact pairs.

Prior inventions in this field pertained to shielded connectors, in which an insulating housing for accommodating the electric contacts is surrounded by an electrically conductive folded and/or bent sheet-metal housing.

SUMMARY OF THE INVENTION

An object of the present invention is to provide a shielding high-density edge connector in which the number of contacts on the terminal side to be connected to the circuit board can be reduced despite a contact arrangement of given density on the mating side of the connector, whereby the number of bores on the corresponding circuit board is reduced.

This object is achieved by providing a connector having a metallic connector housing and an insulating connector insert, wherein the housing contains a plurality of discoidal segments with electric contacts that are embedded in insulating members, wherein the segments are respectively in the form of a ground segment or a signal segment, and in that the ground segment contains ground contact sections that protrude from the insulating member and contact the metallic connector housing.

In a preferred embodiment of the invention the shielding edge connector housing is made of metal which has excellent dimensional stability; however it also is possible to form the housing of metallized plastic.

The edge connector serves for connecting two circuit boards (also referred to as a mother board a daughter board) arranged perpendicular to one another.

It would also be possible to attain a "straight" 180° connection if the contacts in the edge connector housing are designed accordingly.

In adapting this high-density edge connector with adjacently arranged electric contacts embedded in accordance with wafer technology, the inventors aimed, in particular, to reduce the number of terminal contacts in order to disentangle the large number of strip conductors and their bores on the mother board. Since the contacts are adjacently arranged in a basic grid of 0.75 mm on the mating side, it is difficult to disentangle the signal paths leading to the bore holes on the terminal side. Consequently, it is necessary to either offset the individual rows of bores or to increase the spacing between the rows of bores.

The connector of the present invention is designed for transferring differential signals by means of a direct mating with the strip conductors of the daughter board. Strip conductors are provided on both sides of the daughter board for this purpose.

In this case, two adjacently arranged contacts on one side of the circuit board and two adjacently arranged contacts on the other side of the circuit board respectively form a differential signal pair.

One of the upper and the lower contacts thereof also are combined into a signal segment.

The two differential signal pairs consequently connect one circuit board to the other circuit board by means of two adjacently arranged signal segments. A ground segment advantageously is arranged to the right and the left of both signal segments in order to shield the signal pair relative to the next differential pair, wherein the contact sections of said ground segment are directly connected to the metallic connector housing, i.e., the connector is grounded because it is in contact with the connector housing due to its mounting on the mother board. This also makes it possible to safely touch the connector.

It also is advantageous that the direct connection between the ground segments and the electrically conductive connector housing eliminates the need to produce these contacts individually on the mother board. This not only reduces the number of bores, but also makes it possible to increase the spacing between the bores and to simplify the disentanglement of the strip conductors.

Consequently, the disentanglement is achieved by connecting only the signal contacts to the mother board via the connector while the ground contacts are connected to the mother board via an electrically conductive sleeve of the connector housing.

However, one or more signal segments in the form of ground segments also may be connected to the circuit board in other variations of the connector. It is preferred that the signal segments and ground segments can be adjacently inserted into the connector housing in a certain configuration, wherein two signal segments are respectively shielded by a ground segment.

Elongated structures extending in the mating direction are provided in the connector housing on the upper and the lower side thereof, wherein the signal segments can be inserted between these structures.

In this case, the ground segments are inserted into the space of reduced height between the structures such that the signal segments and ground segments can be adjacently arranged within the connector housing in a closely staggered fashion.

It also would be possible to provide a signal segment in the form of a double segment, wherein four electric contacts are embedded in an insulating housing instead of only two electric contacts.

BRIEF DESCRIPTION OF THE DRAWINGS

One embodiment of the invention is illustrated in the figures and described in greater detail below. The figures show.

DETAILED DESCRIPTION OF THE INVENTION

Figure 1A:
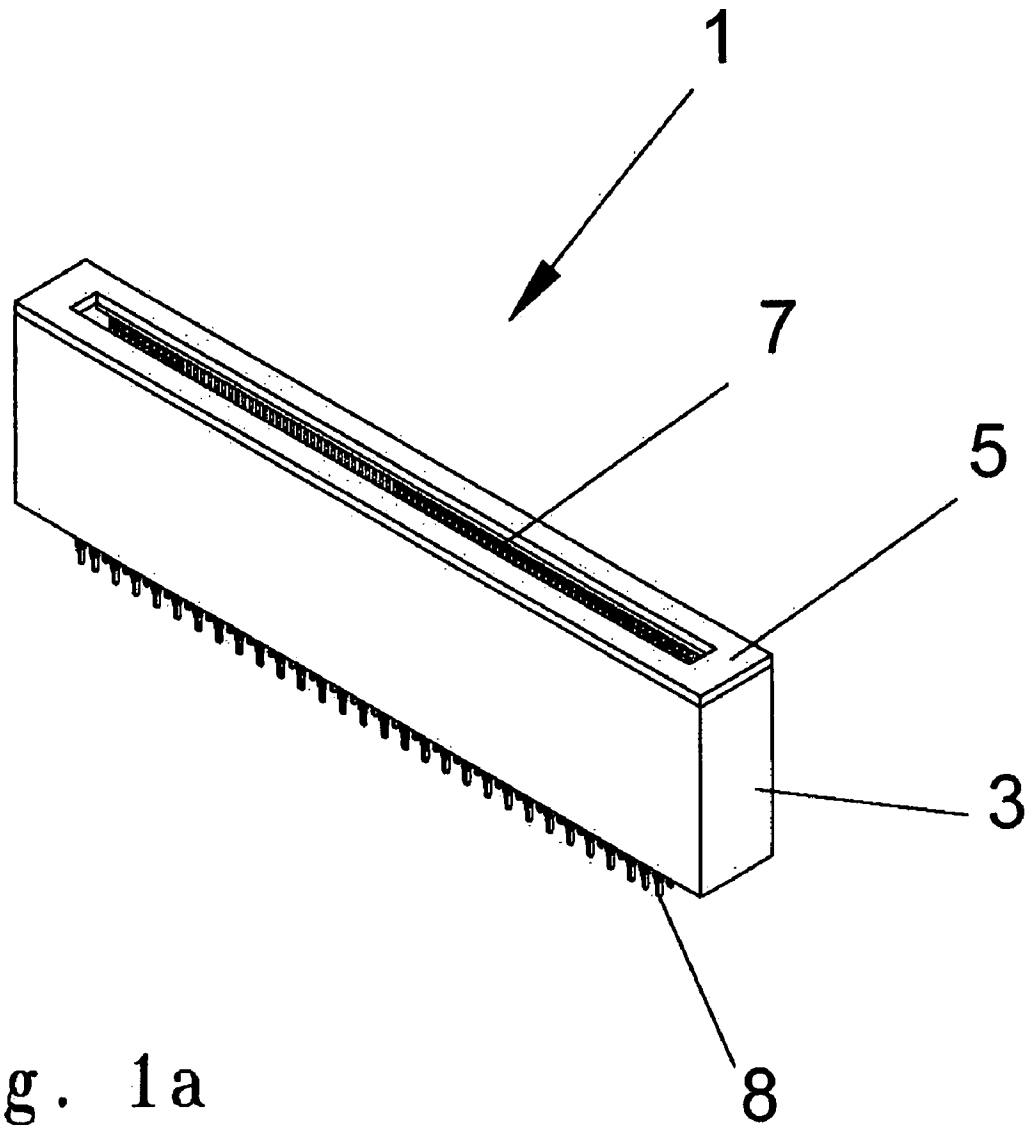
FIG. 1*a* is a perspective view of an edge connector.

FIG. 1*a* shows an edge connector 1 that essentially consists of a metallic housing 3 and a connector insert 5 of an insulating material, wherein the shape of the connector insert on the mating side 7 defines the mating pattern and the opposite terminal side 8 contains the electric contacts.

Figure 1B:
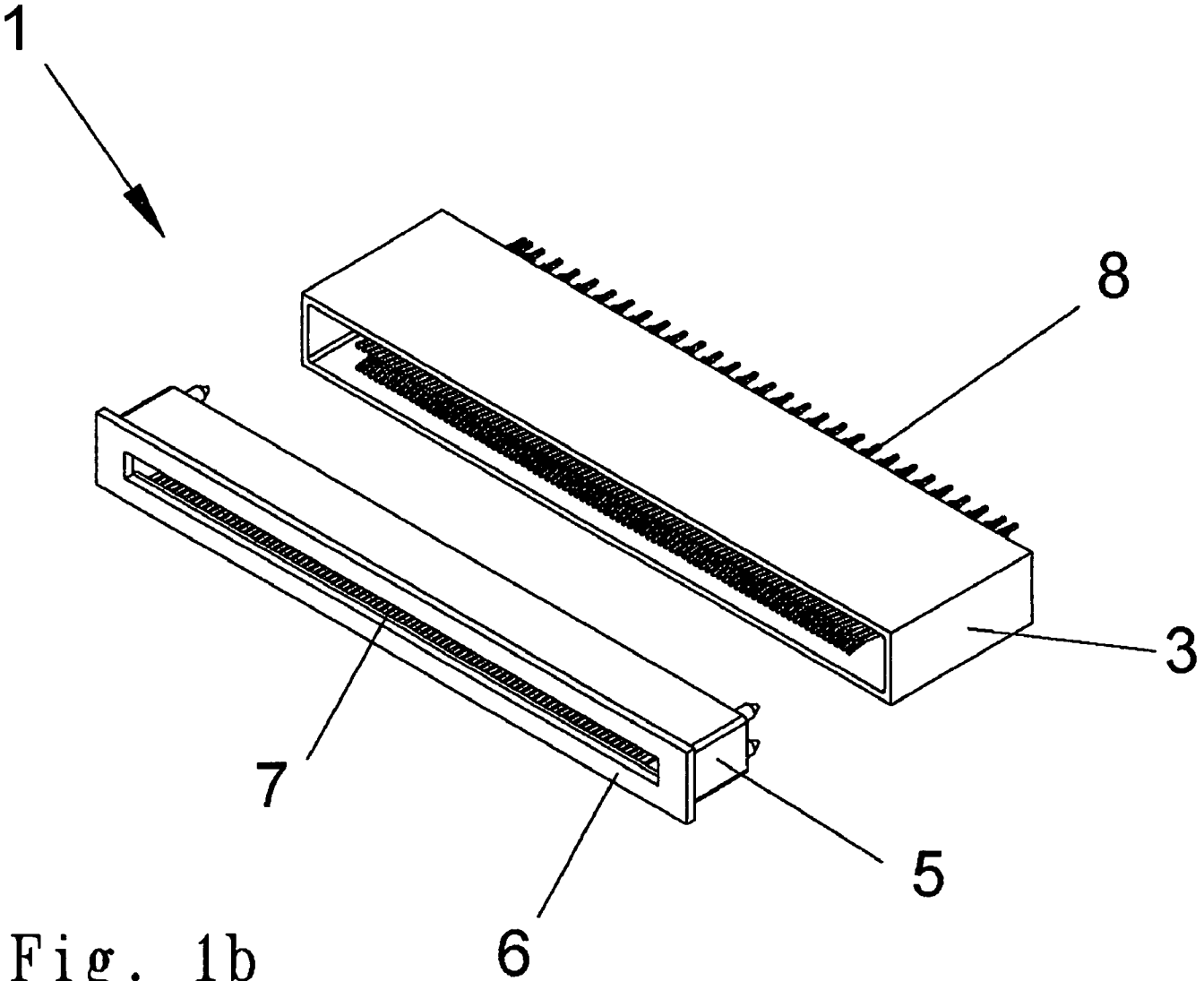
FIG. 1*b* is a perspective view of the edge connector with the connector housing and the separately illustrated connector insert.

In FIG. 1*b*, the metallic housing 3 with the terminal side 8 is illustrated separately of the connector insert 5 with its faceplate 6.

Figure 2A:
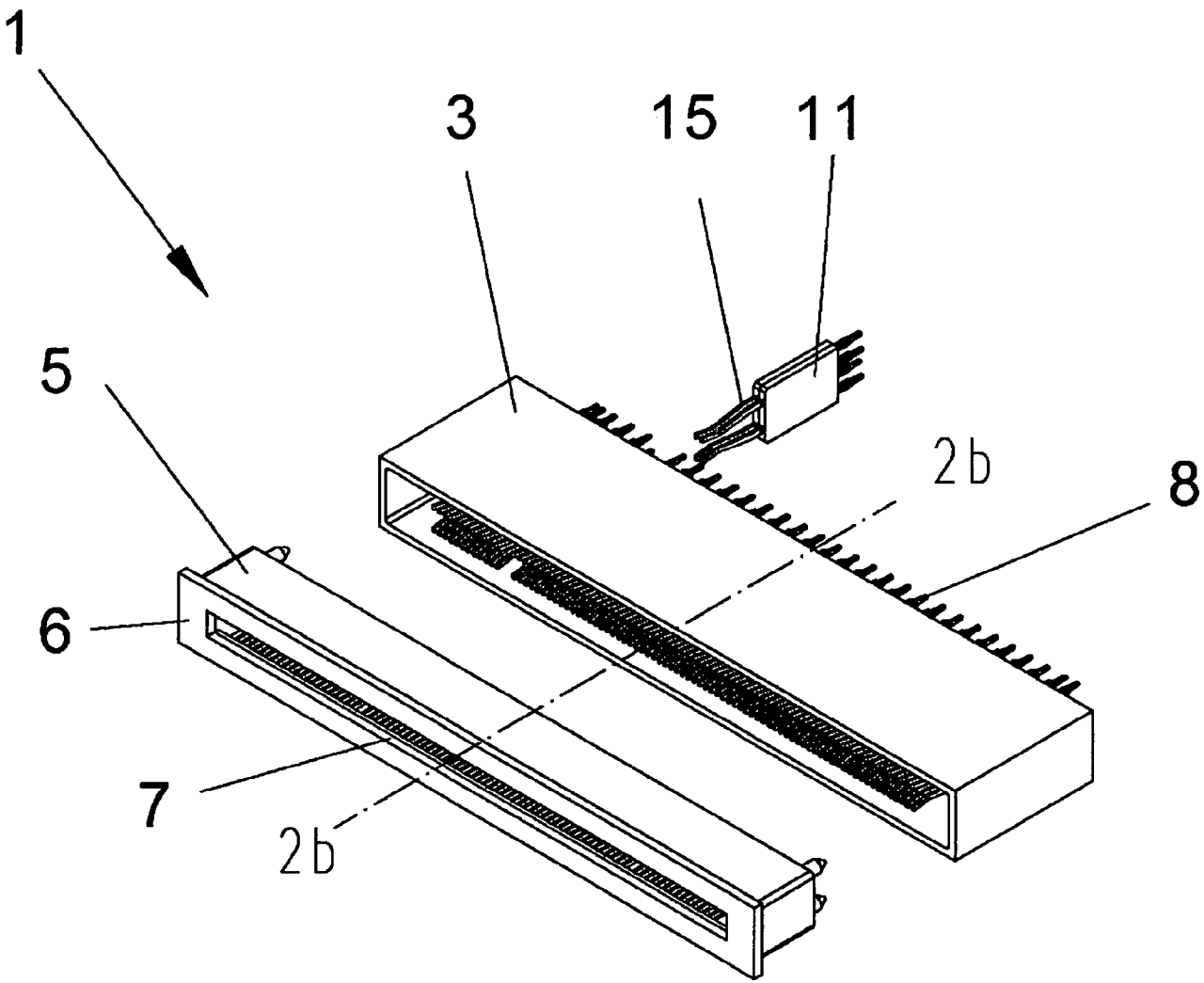
FIG. 2*a* is a perspective view of the edge connector according to FIG. 1*b* with separate segments.

FIG. 2*a* shows another exploded view of an edge connector 1 comprising the metallic housing 3 and the connector insert 5, wherein this figure also shows removed discoid segments 11 with pairs of electric contacts 15 embedded therein.

Figure 2B:
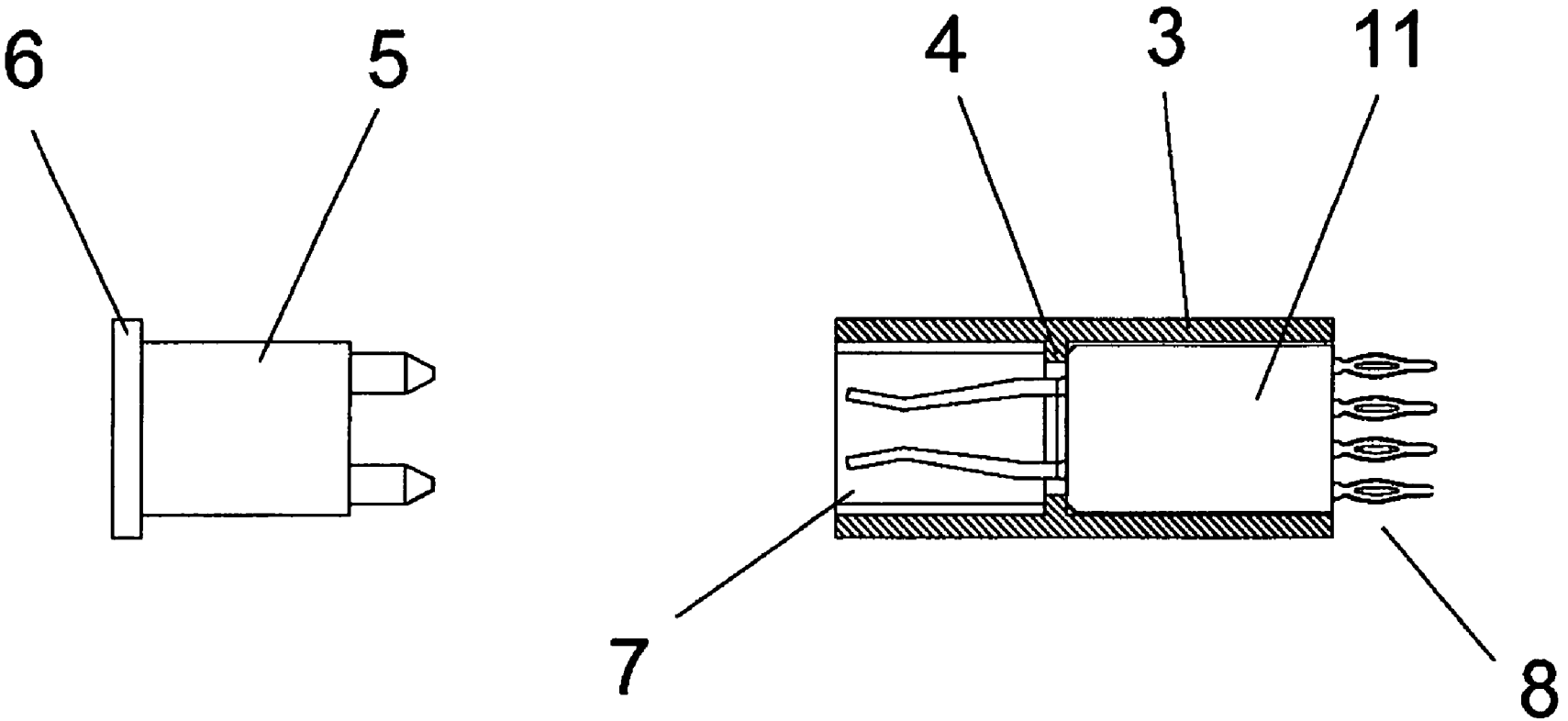
FIG. 2*b* is a cross section through the edge connector according to FIG. 2*a;*

According to the sectional representation shown in FIG. 2*b*, the segments 11 are inserted into the interior of the housing 3 from the terminal side 8 until a limit stop 4 is reached. The connector insert 5 can be inserted from the mating side 7.

The invention proposes to non-positively insert the segments into the metallic housing adjacent to one another from the upper and lower sides such that they exert a certain pressure upon the narrow sides.

Figure 3:
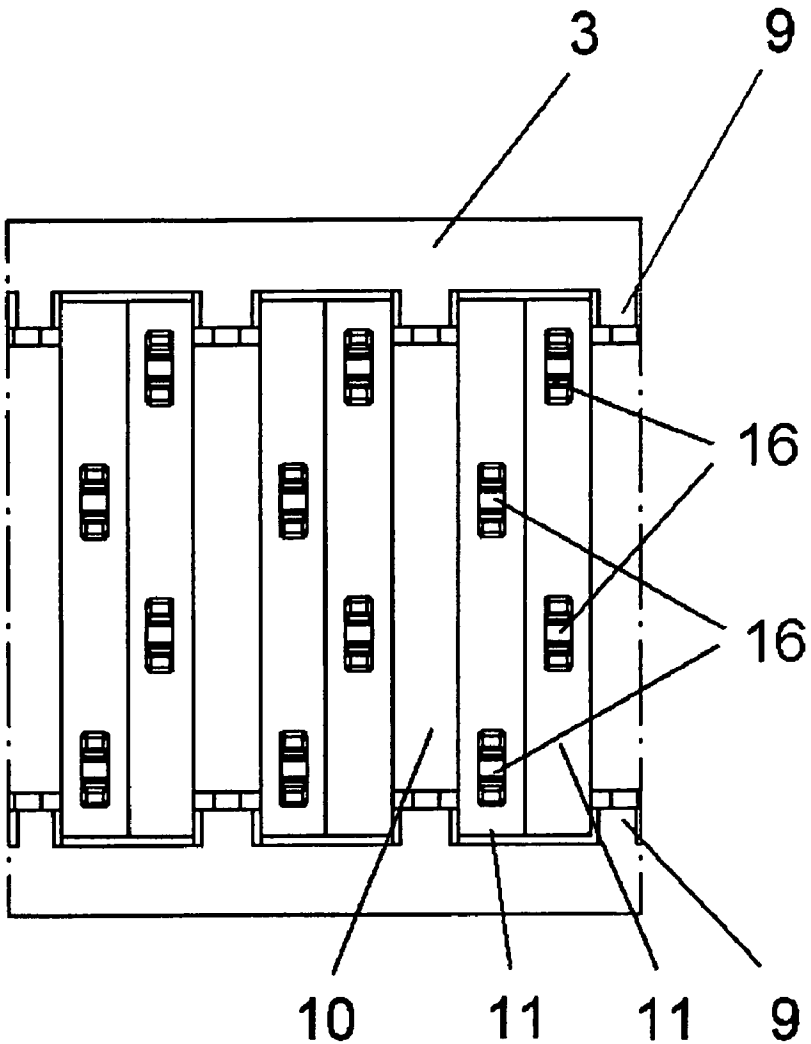
FIG. 3 is a side elevational view of a portion of the terminal side of the edge connector.

FIG. 3 shows a detailed representation of the terminal side of the edge connector with segments 10, 11 inserted therein.

Contacts 16 protruding from the segments 11 are also illustrated in this figure.

Structures 9 are arranged on both side walls of the metallic housing 3 such that they are equidistantly spaced apart from one another and point into the housing interior.

The signal segments 11 are respectively inserted into sections formed by two structures 9 while one respective ground segment 10 is inserted into the remaining space. Ground segment 10 is shorter than the signal segment 11 such that it can be inserted between the opposite structures 9.

Figure 4B:
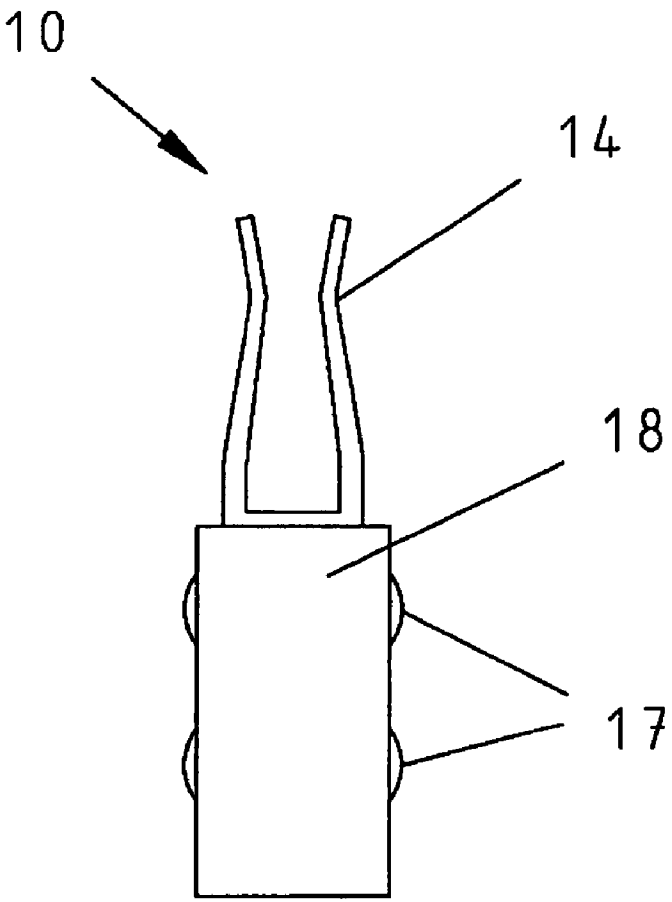
FIG. 4*b* is a top plan view of the ground segment 10 of FIG. 4*a;*
Figure 4A:
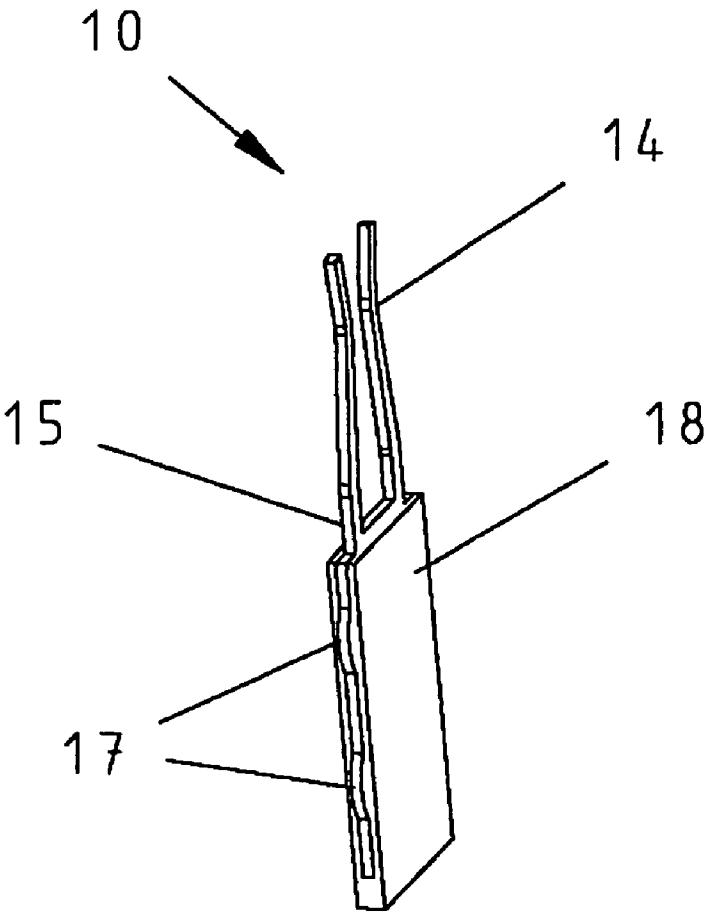
FIG. 4*a* is a perspective representation of a ground segment 10.

FIG. 4 shows a ground segment 10, in perspective representation in FIG. 4*a* and in top plan view in FIG. 4*b*.

The ground segment 10 comprises an insulating member 18 with a contact element 15 embedded therein, wherein two fork-shaped mating contacts 14 are provided on the mating side and ground contact sections 17 protrude from the side walls of the insulating member.

When the ground segment is inserted, the ground contact sections 17 directly contact the structures 9 on the upper and lower side of the metallic housing 3.

Since no direct contacts need to be produced between the ground segments 10 and the mother board, the number of bores on the mother board required for transferring the measuring signals can be reduced.

Figure 5A:
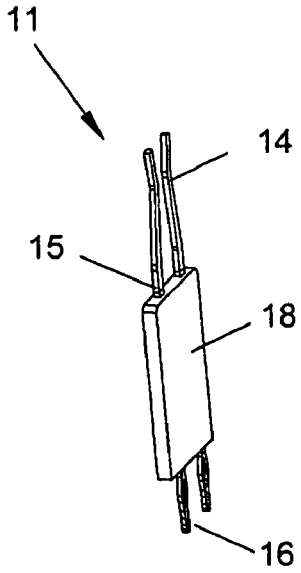
FIG. 5*a* is a perspective view of a signal segment 11.
Figure 6A:
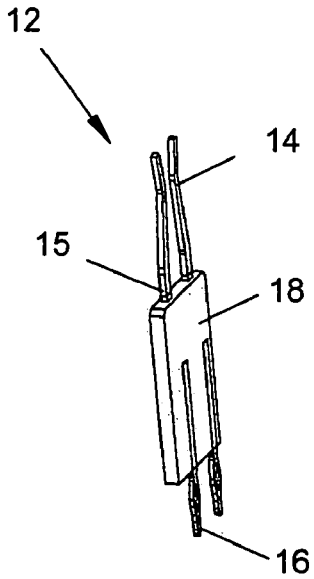
FIG. 6*a* is a perspective view of a signal segment 12.
Figure 7A:
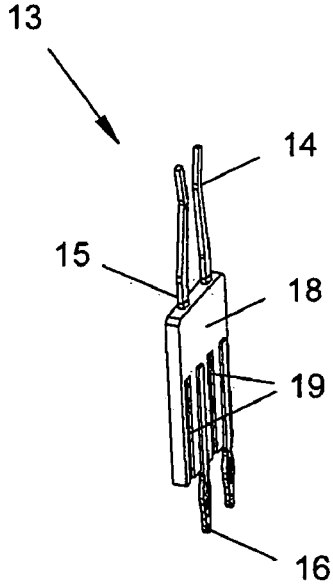
FIG. 7*a* is a perspective representation of a signal segment 13.

FIGS. 5, 6 and 7 show a few variations of signal segments 11, 12, 13.

The signal segments 11, 12, 13 respectively comprise two electric contacts 15 that are surrounded by an insulating member 18, wherein two respective mating ends 14 form a tulip-shaped contact for contacting the strip conductors of a double-sided daughter board.

Straight contacts 16 extending out of the opposite side of the insulating member are pressed or soldered onto the mother board.

The contacts may be bent by 90° such that the straight connector shown also can be used as an angle connector.

Figure 5B:
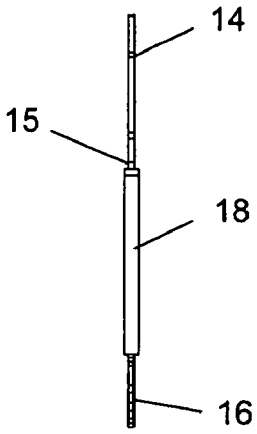
FIG. 5*b* is a side elevational view of the signal segment 11 of FIG. 5*a;*

In the side view according to FIG. 5*b*, the signal segment 11 has a contact 15 that is arranged centrally within the insulating member 18—referred to the side walls thereof.

Figure 6B:
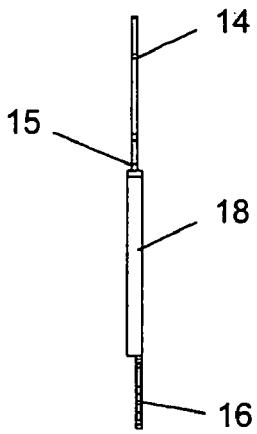
FIG. 6*b* is a side elevational view of the signal segment 12 of FIG. 6*a;*

The signal segments 12 in FIG. 6*b* have eccentrically arranged contacts 16 on the terminal side, wherein the contacts end practically flush with one side wall of the insulating member 18.

Figure 7B:
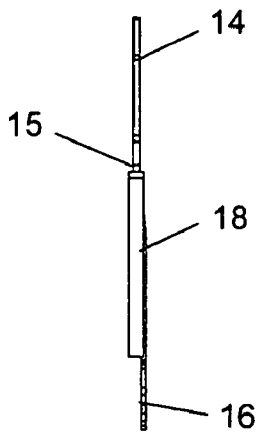
FIG. 7*b* is a side elevational view of the signal segment 13 of FIG. 7*a;*

FIG. 7*b* shows a signal segment 13, in which at least half the material thickness of the contact 16 is arranged laterally outside the insulating member 18.

Figure 8A:
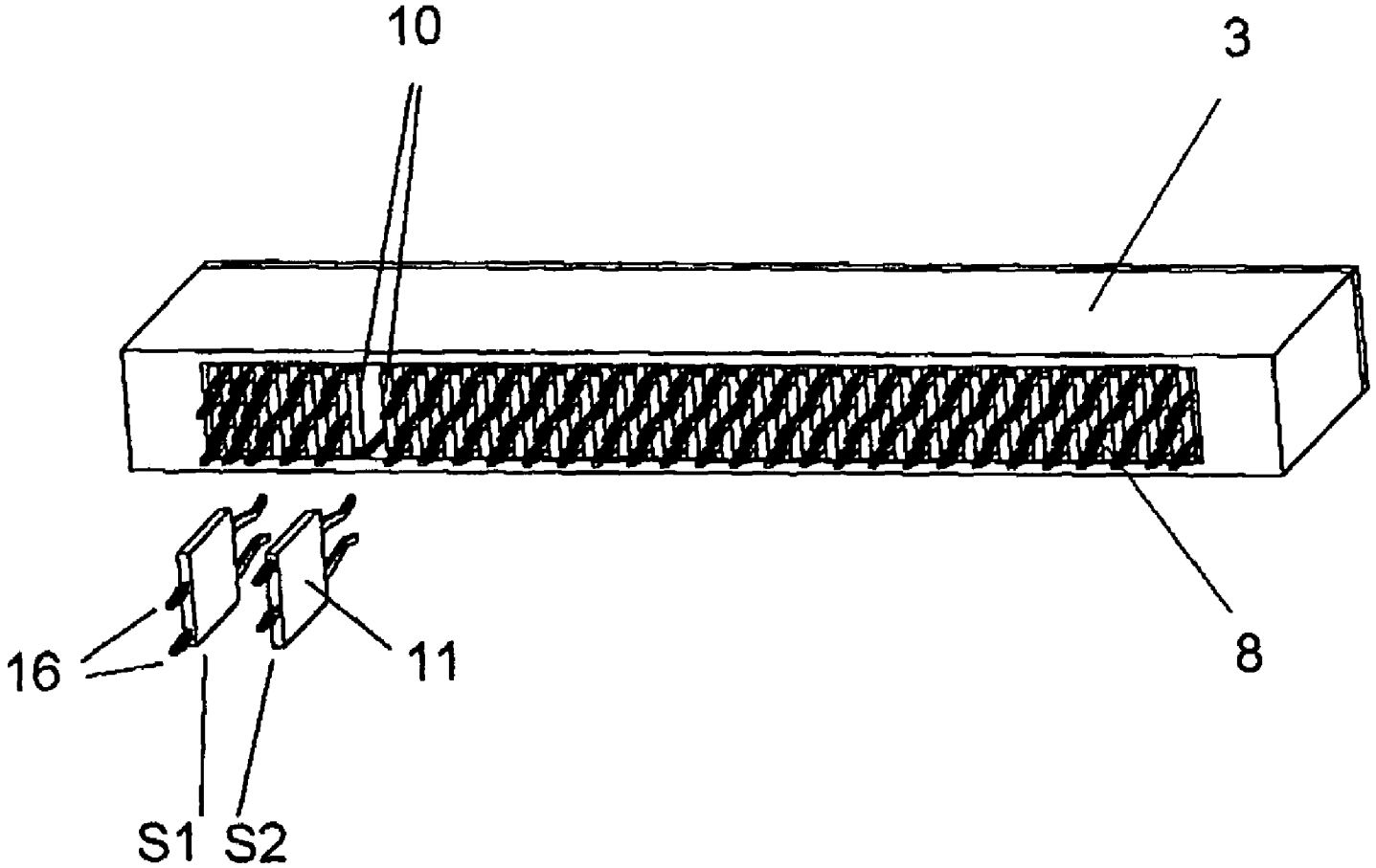
FIG. 8*a* is a terminal side view of an edge connector with the signal segment 11.

FIG. 8*a* shows the terminal side of an edge connector with the metallic housing 3, in which the signal segments 11 and ground segments 10 are arranged in a row as described above. Two signal segments 11 and one ground segment 10 are alternately arranged adjacent to one another in this case.

Two signal segments 11 are shown removed in the figure and arranged such that the contacts 16 are positioned in the first and in the third quarter—the so-called segment height—in one segment (S1) and in the second and in the fourth quarter in the adjacent segment (S2). With respect to the identical segments shown, this is achieved by simply turning an adjacent segment by 180° (in this respect, see also FIG. 3).

Figure 8B:
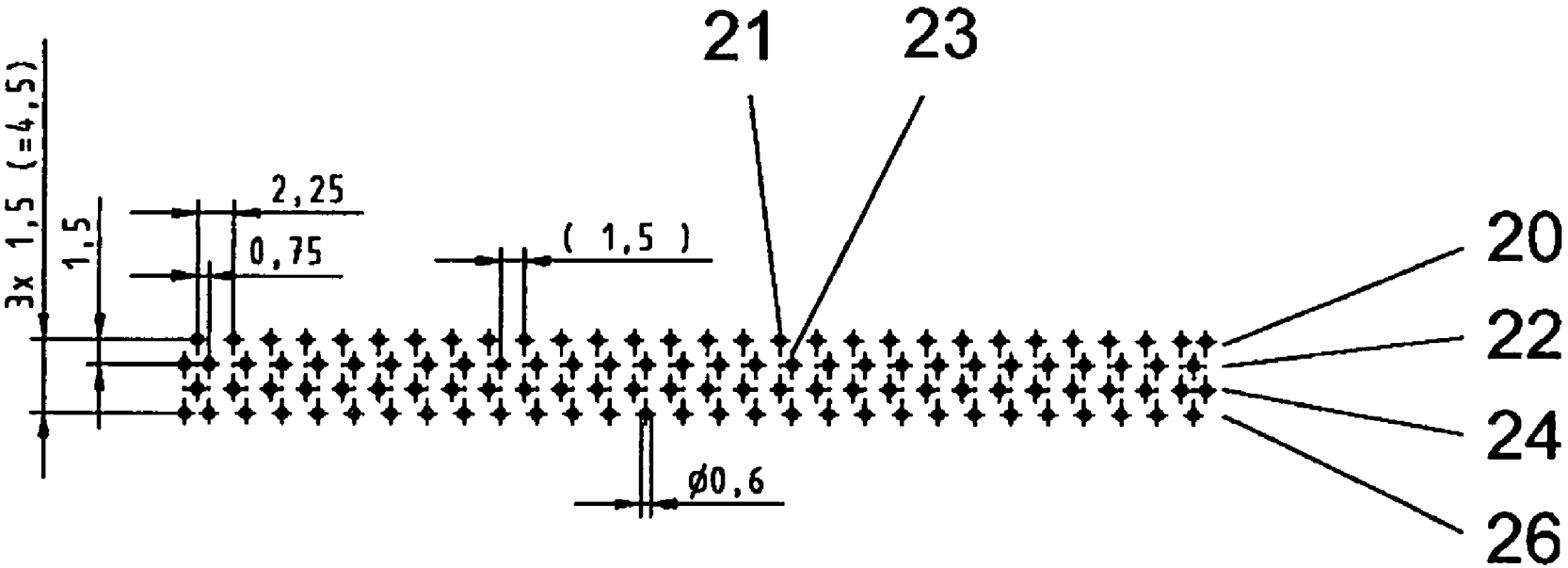
FIG. 8*b* shows the contact pattern of the edge connector made according to FIG. 8*a;*

FIG. 8*b* shows an arrangement of bores on the circuit board that corresponds to the edge connector according to FIG. 8*a*. Thus, with the present invention, the five rows that are required in conventional connectors and also include the ground contacts are reduced to four parallel rows 20, 22, 24, 26 of bores that are spaced apart from one another by 1.5 mm, wherein the bores of a row are spaced apart from one another by 2.25 mm.

The rows 22 and 26 are laterally offset relative to the rows 20 and 24 by 0.75 mm.

This is illustrated with reference to the individual bores 21 and 23 of the rows 20, 22.

Figure 9A:
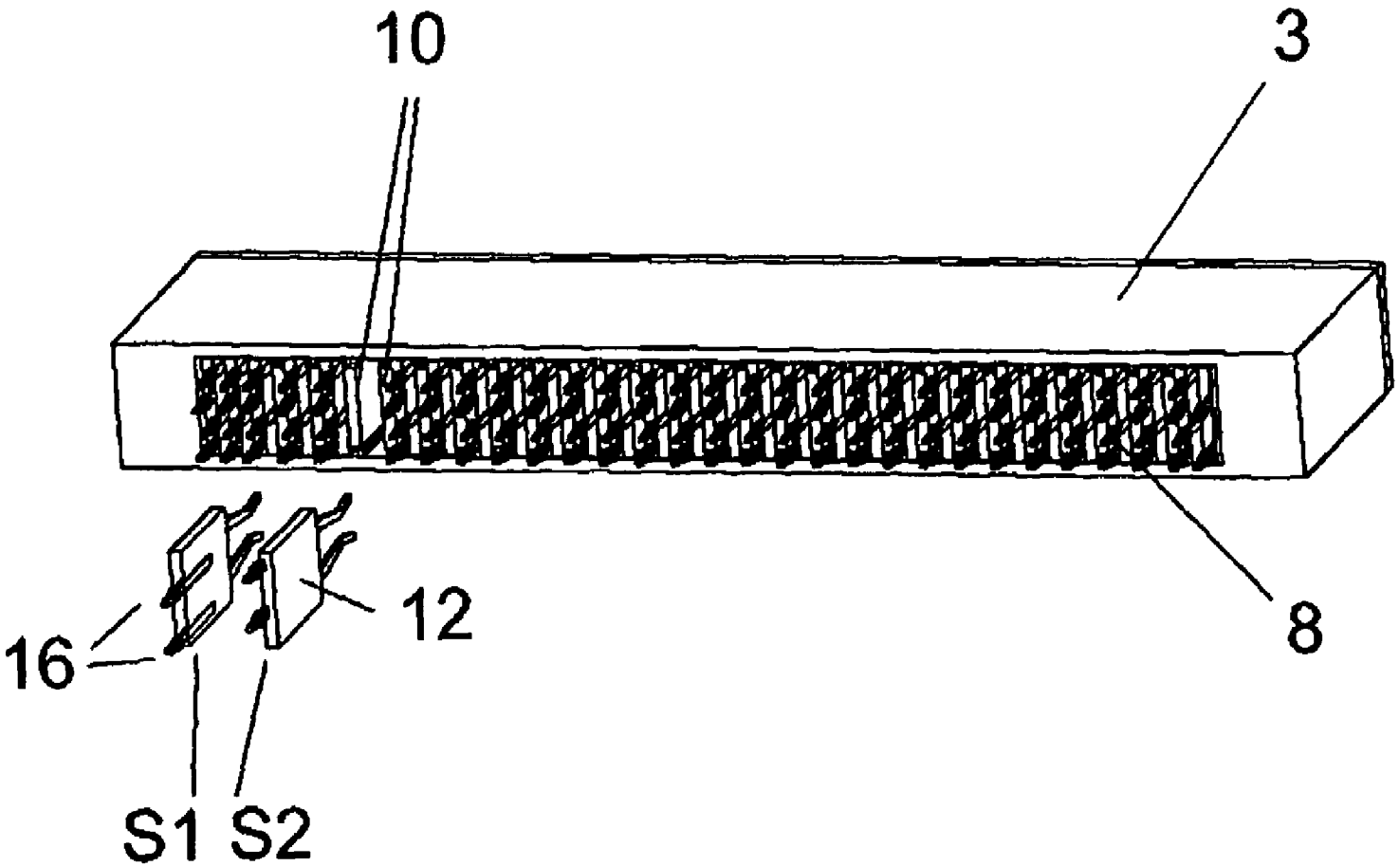
FIG. 9*a* is a terminal side view of an edge connector with the signal segment 12.

FIG. 9*a* shows the terminal side of an edge connector made in accordance with the present invention with signal segments 12 and ground segments 10.

Figure 9B:
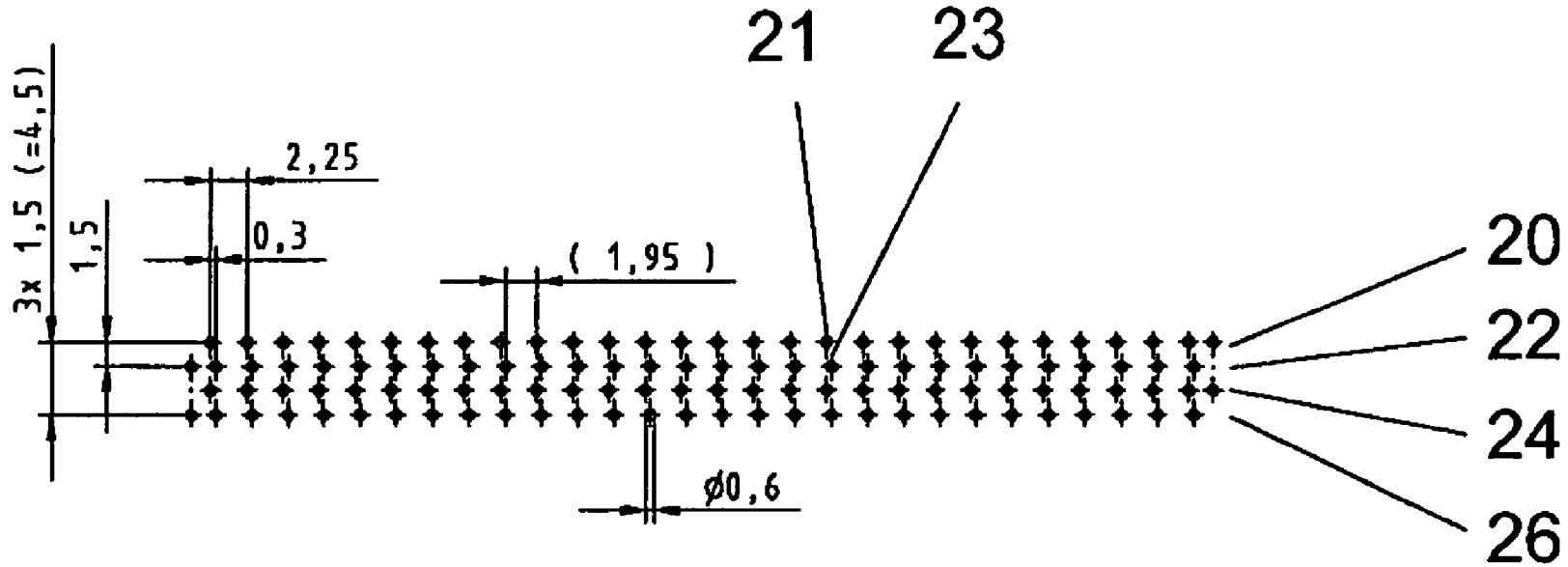
FIG. 9*b* shows the contact pattern of the edge connector made according to FIG. 9*a;*
Figure 10A:
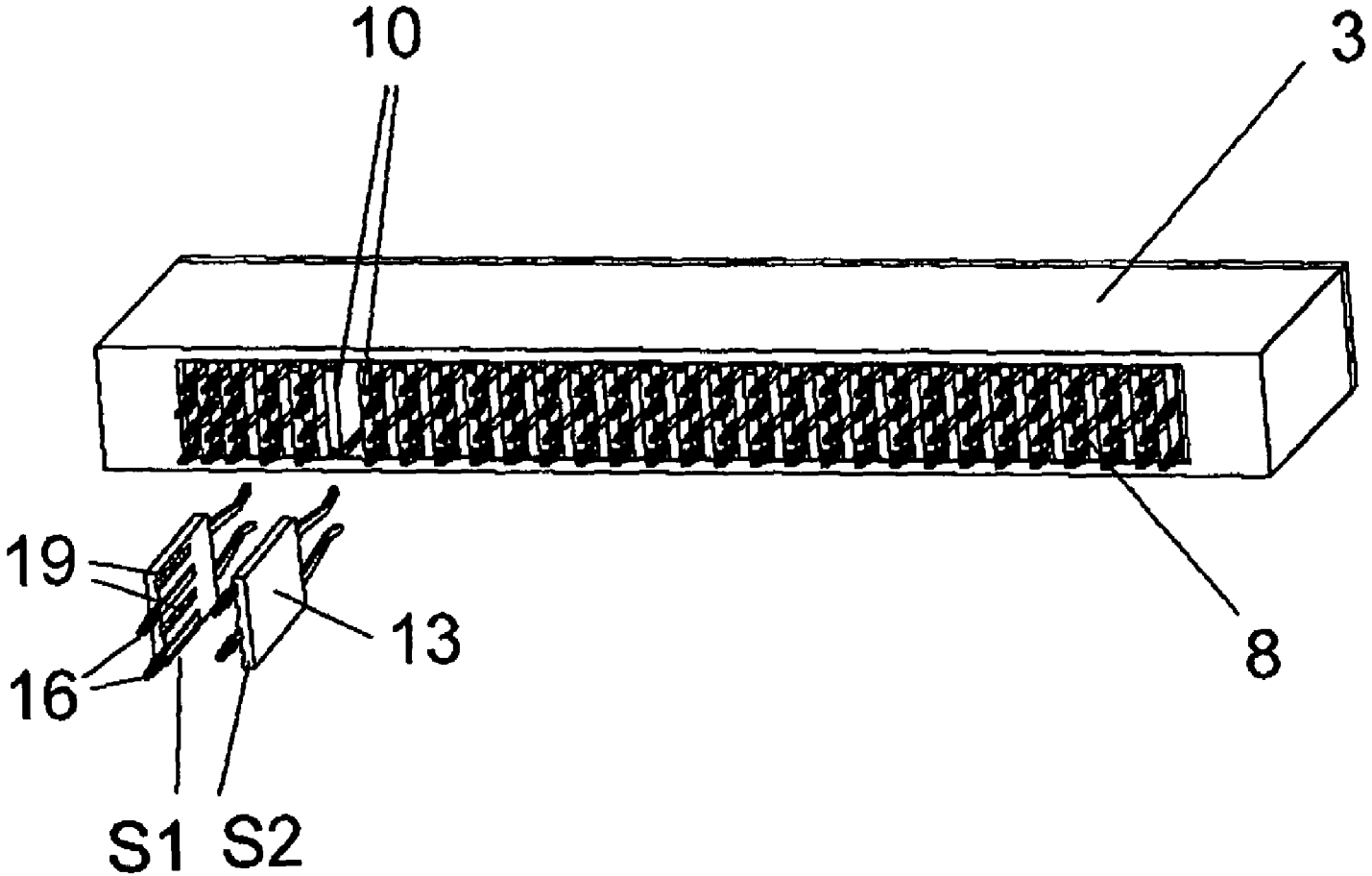
FIG. 10*a* is a terminal side view of an edge connector with the signal segment 13.
Figure 10B:
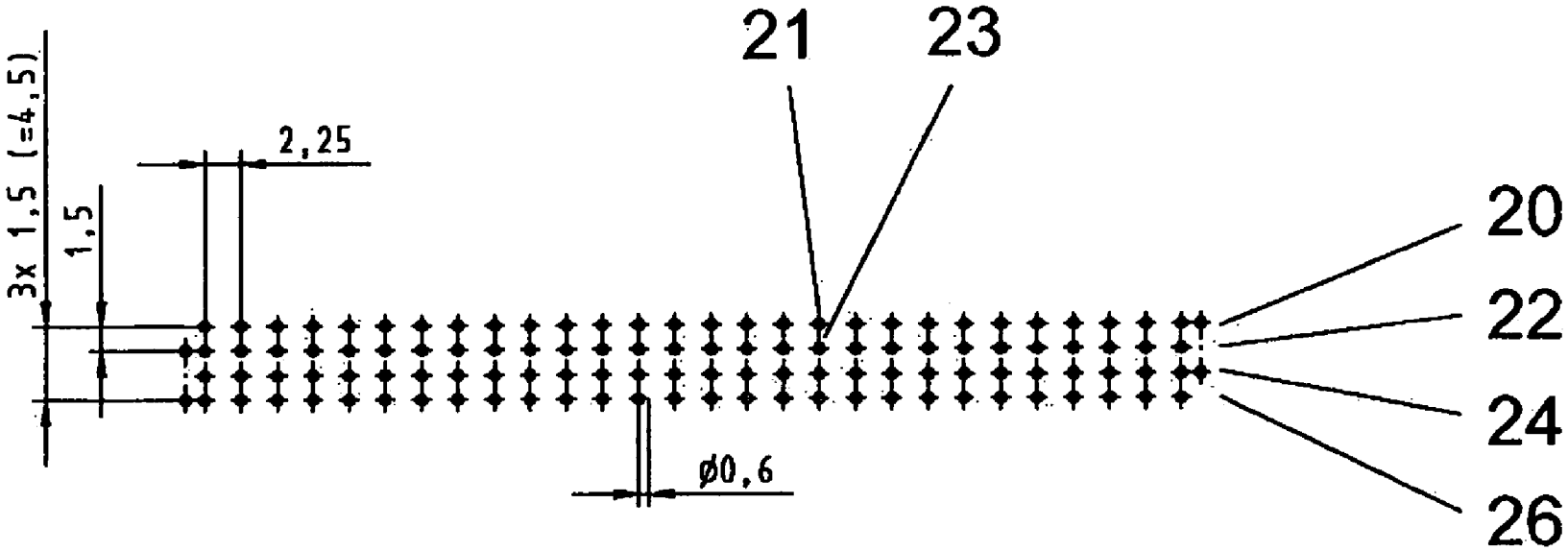
FIG. 10*b* shows the contact pattern of the edge connector made according to FIG. 10*a.*

The very compact contact pattern shown in FIG. 9*b* is achieved because the contacts 16 of the signal segments 12 end practically flush with the side wall of the insulating member 18 and the adjacently arranged segments are also turned by 180°.

The invention claimed is:

1. A shielded high-density edge connector with a terminal side for connection to a mother board and a mating side for connection to a daughter board, wherein the connector comprises a metallic connector housing and an insulating connector insert, wherein the housing includes a plurality of discoidal segments with electric contacts that are embedded in insulating members, wherein the segments are respectively in the form of a ground segment or a signal segment, and wherein each ground segment contains has ground contact sections that protrude from the insulating member and contact the metallic connector housing.

2. The edge connector according to claim 1, wherein the electric contacts have fork-shaped mating ends that are arranged centrally therein and protrude in a mating direction.

3. The edge connector according to claim 1, wherein the electric contacts of the signal segments have terminal ends in the insulating members that are respectively arranged in first and third rows in the insulating member.

4. The edge connector according to claim 1, wherein the electric contacts provided in the insulating members of the signal signal have terminal ends that are arranged centrally to a width of the insulating members.

5. The edge connector according to claim 1, wherein terminal ends of the electric contacts in the insulating members of the signal segments are arranged eccentrically to a width of the insulating members.

6. The edge connector according to claim 1, wherein terminal ends of the electric contacts in the signal segments are partially arranged outside the insulating members, and recesses for terminal ends arranged outside the insulating members are provided in an insulating member of an adjacent signal segment.

7. The edge connector according to claim 1, wherein the signal segments and the ground segments are alternately arranged adjacent one another in the connector housing.

8. The edge connector according to claim 1, wherein structures are provided inside the housing on an upper and lower surface thereof, wherein the segments are arranged between said structures.

9. The edge connector according to claim 1, wherein the electric contacts in the signal segments have perpendicularly bent contact sections.

10. The edge connector according to claim 1, wherein the edge connector comprises a signal segment with four electric contacts embedded therein.

* * * * *

UNITED STATES PATENT AND TRADEMARK OFFICE

CERTIFICATE OF CORRECTION

PATENT NO. : 7,101,225 B2
APPLICATION NO. : 11/280598
DATED : September 5, 2006
INVENTOR(S) : Kohler It is certified that error appears in the above-identified patent and that said Letters Patent is hereby corrected as shown below:

Claim 1, Col. 5, line 12, “segment contains has ground” should be --segment has ground--.
Claim 4, Col. 5, line 24, “members of the signal signal have” should be --members of the signal have--.

Signed and Sealed this

Third Day of February, 2009

JOHN DOLL
*Acting Director of the United States Patent and Trademark Office*